US011565870B2

(12) United States Patent
Briggs

(10) Patent No.: US 11,565,870 B2
(45) Date of Patent: Jan. 31, 2023

(54) BEVERAGE INSULATOR AND CADDY

(71) Applicant: Joshua Briggs, Tiffin, OH (US)

(72) Inventor: Joshua Briggs, Tiffin, OH (US)

( * ) Notice: Subject to any disclaimer, the term of this patent is extended or adjusted under 35 U.S.C. 154(b) by 0 days.

(21) Appl. No.: 17/000,948

(22) Filed: Aug. 24, 2020

(65) Prior Publication Data

US 2021/0053743 A1 Feb. 25, 2021

Related U.S. Application Data

(60) Provisional application No. 62/890,308, filed on Aug. 22, 2019.

(51) Int. Cl.
*B65D 81/38* (2006.01)
*A47G 23/02* (2006.01)
*B65D 43/02* (2006.01)

(52) U.S. Cl.
CPC ..... *B65D 81/3881* (2013.01); *A47G 23/0216* (2013.01); *B65D 43/0231* (2013.01)

(58) Field of Classification Search
CPC ..... B65D 81/3876; B65D 81/3879; B65D 81/3881; B65D 81/3883; B65D 81/3886; B65D 81/3865; B65D 81/3867; B65D 81/3869; B65D 81/3872; B65D 81/3874; B65D 81/3888; B65D 81/389; B65D 81/3893; B65D 81/3895; B65D 81/3897; B65D 43/0225; B65D 43/0229; B65D 47/00; B65D 47/04; B65D 47/06
See application file for complete search history.

(56) References Cited

U.S. PATENT DOCUMENTS

| | | | | |
|---|---|---|---|---|
| 8,251,247 | B1 * | 8/2012 | Breckner | A47G 23/0241 220/592.16 |
| 9,655,463 | B2 * | 5/2017 | Madala | B65D 81/3876 |
| 10,005,608 | B1 * | 6/2018 | Jacob | B65D 43/0229 |
| D836,406 | S * | 12/2018 | Roberts | D7/624.2 |
| 10,677,516 | B2 * | 6/2020 | Huisman | B65D 21/083 |
| 10,835,067 | B2 * | 11/2020 | Rane | B65D 81/3881 |
| 2012/0318812 | A1 * | 12/2012 | Leser | B29C 66/1122 220/739 |
| 2018/0242765 | A1 * | 8/2018 | Rane | A47G 23/0241 |

* cited by examiner

*Primary Examiner* — Javier A Pagan
(74) *Attorney, Agent, or Firm* — Ward Law Office LLC; Jacob M. Ward

(57) ABSTRACT

A beverage insulator has a main body that is configured to receive a beverage container. The main body has a bore with a helical groove formed therein. The helical groove is configured to facilitate a formation of one or more air pockets between the bore of the main body and the beverage container when disposed in the main body. The main body has a major interior surface formed from a plurality of angled walls. The angled walls may facilitate to grip the beverage container when disposed in the main body. A kit for a beverage insulator includes a beverage insulator and a caddy. The beverage insulator has a main body configured to receive a beverage container. The caddy has a holder configured to selectively receive the beverage insulator, and a shelving portion disposed on the holder. The shelving portion is configured to selectively receive a plurality of lids.

7 Claims, 6 Drawing Sheets

BEVERAGE INSULATOR AND CADDY

CROSS REFERENCE TO RELATED APPLICATIONS

This application claims the benefit of U.S. Provisional Application Ser. No. 62/890,308, filed on Aug. 22, 2019. The entire disclosure of the above application is hereby incorporated herein by reference.

FIELD

The disclosure generally relates to an insulator and, more specifically, an insulator for a beverage container.

BACKGROUND

A common problem among people who enjoy drinking either hot or cold beverages is the rate at which the beverage reaches room temperature. Warming by the sun, air temperature, or even the body heat of the user, can significantly increase the rate at which certain beverages reach room temperature and become unappetizing. Temperature maintenance can therefore be important for maximum enjoyment of a beverage, whether it be a hot or a cold beverage.

Numerous varieties of thermal insulating sleeves are available for insulating beverage containers, such as cans and bottles for soft drinks and beer. These sleeves slide over the container to provide an insulating exterior surface, insulating the beverage container from ambient temperature and thus slowing the rate of heat flow between the ambient environment and the beverage and its container. These sleeves are available in an assortment of sizes for use with various container types, including but not limited to paper, plastic, glass, and aluminum beverage containers. Use of an insulating sleeve is advised for both hot and cold beverages. Typically, the insulating sleeve is made from polyethylene foam, a material known for its thermal insulating properties.

Tests conducted on beverages packaged in glass bottles prove the beneficial effects of the insulating sleeve. Two bottles were chilled and the temperature of the liquid contained therein was measured, one bottle having an insulating beverage sleeve and the other without. As expected, the liquid in the sleeve-insulated bottle retained a lower temperature for a considerably longer period than the uninsulated container.

Prior art sleeve insulators include foam and neoprene "koozies." Koozies are insulated wraps for receiving a container, such as a cylindrical can or bottle. They are usually cylindrical and comprised of foam, neoprene rubber, polyester, open cell foam, plain foam, or foam variants of neoprene, and may have a height that is somewhat less than the container they receive, leaving an exposed top portion of the container so that one may easily drink a beverage from the container. Such koozies typically snugly receive the container in a resilient foam body.

However, known koozies still have many disadvantages. Neoprene koozies may become wet with use, and likewise, the koozie may be undesirable to hold. Additionally, the moisture may cause the koozie to become slick and may fall from a user's hand.

There is a continuing need for a beverage insulator which militates against the temperature of the beverage increasing, while still remaining easy to use.

SUMMARY

In concordance with the instant disclosure, a beverage insulator which militates against the temperature of the beverage changing, while still remaining easy to use, has been surprisingly discovered.

In one embodiment, a beverage insulator has a main body that is configured to receive a beverage container. The main body has a bore with a helical groove formed therein. The helical groove is configured to facilitate a formation of one or more air pockets between the bore of the main body and the beverage container when disposed in the main body.

In another embodiment, a beverage insulator has a main body that is configured to receive a beverage container. The main body has a major interior surface formed from a plurality of angled walls. The plurality of angled walls is configured to facilitate friction between the major interior surface of the main body and the beverage container where disposed in the main body thereby securing the beverage container within the main body.

In a further embodiment, a kit for a beverage insulator includes a beverage insulator and a caddy. The beverage insulator has a main body configured to receive a beverage container. The caddy has a holder configured to selectively receive the beverage insulator, and a shelving portion disposed on the holder. The shelving portion is configured to selectively receive a plurality of lids.

In an exemplary embodiment, a beverage insulator has a hollow main body. The hollow main body includes a top end, an inner surface, and a bottom end.

The hollow main body is configured to act as a sleeve for a beverage container, such as a standard aluminum can or glass bottle. Therefore, the dimensions of the main body are scalable in order to accommodate different beverage containers.

The hollow main body may have a height of 107 mm and a width of 80 mm. It should be appreciated that while these dimensions are shown to be useful for certain beverage containers, a skilled artisan may select different dimensions of the hollow main body to accommodate different types of beverage containers.

The hollow main body may be constructed from plastic, wood, metal, or a composite material. In some examples, the hollow main body may be made of plastic. However, different materials, capable of acting as insulators, can be selected within the scope of this disclosure.

In some embodiments, the hollow main body includes a hand grip. The hand grip is configured to permit a user to more securely grip the beverage insulator during use. The hand grip may consist of a plurality of ridges and corresponding lands disposed on the main body. The plurality of ridges may be positioned in such a way that allows a finger of a user to be disposed between two ridges thereby providing a grip during use.

The top end has a cylindrical aperture formed thereon. The cylindrical aperture is configured to receive a beverage container. The cylindrical aperture may have a diameter of 66 mm. It should be appreciated that although this size has been shown to be useful, other sizes may be selected in order to accommodate different sized beverage containers.

The inner surface has at least one groove formed thereon. In particular, the groove may be formed in a helix-like configuration. It is believed that the helix-like configuration facilitates in the formation of one or more air pockets. Advantageously, the one or more air pockets are sandwiched between the beverage container and the inner surface and provide additional insulation to the beverage container.

In some embodiments, the inner surface includes a plurality of raised portions disposed thereon. The plurality of raised portions may be configured to press against the beverage container, gripping the beverage container into a fixed position. It should be appreciated that a skilled artisan may select any number of raised portions within the scope of this disclosure.

The beverage container may include a lid. The lid may be configured to prevent the beverage container from falling out of the hollow main body. The lid can include an aperture. The aperture may be configured to permit the contents of the beverage container to flow therethrough.

The beverage container may include a grip lid. The grip lid has an aperture and at least one ridge. The aperture may be configured to permit the contents of the beverage from flowing therethrough. The aperture has at least one protrusion. The protrusion may be configured to correlate to a "L-shaped" channel formed in the top end of the beverage container. The protrusion and the L-shaped channel may be configured to operate as a child lock. The ridge may be configured to permit more traction when a user grips the grip lid. The ridge may be disposed on the grip lid.

The bottom end may include a pad disposed thereon. The pad may be configured to compress the beverage container between the grip lid and the bottom end. Desirably, this fixates the beverage container into a fixed position. In some examples, the pad may be comprised of elastic foam. It should be appreciated that a person skilled in the art may select different materials for the pad, as long as the materials are capable of being compressed and decompressed.

A caddy includes a hollow portion and a shelving portion. The hollow portion is configured to hold the beverage insulator. The hollow portion may include a base with a plurality of walls. It should be appreciated that the size of the hollow portion may be scalable, in order to accommodate a plurality of beverage insulators.

In some examples, the base may include an aperture with a grate. Derisibly, the grate allows any excess liquids that may be spilled from the beverage container to be drained out of the hollow portion.

The shelving portion may have at least one shelf. The shelf may be configured to store the lid or the grip lid. In some embodiments, each of the top and bottom of the shelving portion has an aperture with a grate. Advantageously, the grate drains excess liquids that may drain from the lid or the grip lid.

Further areas of applicability will become apparent from the description provided herein. It should be understood that the description and specific examples are intended for purposes of illustration only and are not intended to limit the scope of the present disclosure.

DRAWINGS

The above, as well as other advantages of the present disclosure, will become readily apparent to those skilled in the art from the following detailed description, particularly when considered in the light of the drawings described hereafter.

DETAILED DESCRIPTION

The following description of technology is merely exemplary in nature of the subject matter, manufacture and use of one or more inventions, and is not intended to limit the scope, application, or uses of any specific invention claimed in this application or in such other applications as may be filed claiming priority to this application, or patents issuing therefrom. Regarding methods disclosed, the order of the steps presented is exemplary in nature, and thus, the order of the steps can be different in various embodiments, including where certain steps can be simultaneously performed. "A" and "an" as used herein indicate "at least one" of the item is present; a plurality of such items may be present, when possible. Except where otherwise expressly indicated, all numerical quantities in this description are to be understood as modified by the word "about" and all geometric and spatial descriptors are to be understood as modified by the word "substantially" in describing the broadest scope of the technology. "About" when applied to numerical values indicates that the calculation or the measurement allows some slight imprecision in the value (with some approach to exactness in the value; approximately or reasonably close to the value; nearly). If, for some reason, the imprecision provided by "about" and/or "substantially" is not otherwise understood in the art with this ordinary meaning, then "about" and/or "substantially" as used herein indicates at least variations that may arise from ordinary methods of measuring or using such parameters.

Figure 1:
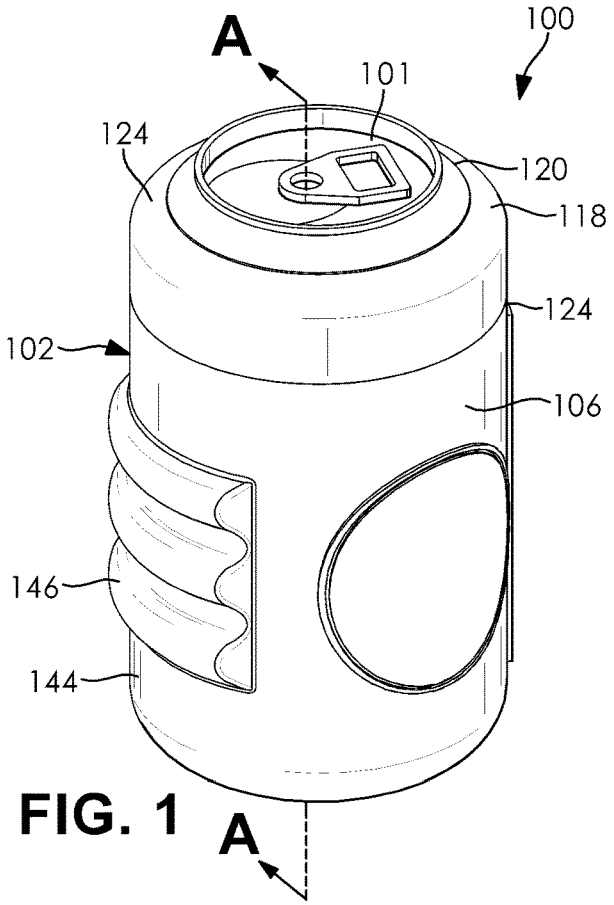
FIG. 1 is a top perspective view of a beverage insulator, according to one embodiment of the present disclosure, further depicting a beverage container disposed in the beverage insulator.

With reference to FIGS. 1-15, a beverage insulator 100 may have a main body 102. It should be appreciated that the main body 102 may be configured to receive a beverage container 101, for example, as shown in FIG. 1. As non-limiting examples, the beverage container 101 may be a can or a bottle. The beverage insulator 100 may be configured to insulate the beverage container 101, or otherwise, be configured to maintain a temperature of a beverage within the beverage container 101. For example, the beverage insulator 100 may militate against or delay a temperature change of a beverage disposed within the beverage container 101, such as warming of a chilled beverage disposed in the beverage container 101.

It should be appreciated that the beverage insulator 100 may be fabricated from a suitable durable material. Desirably, the durable material has a sufficiently high impact resistance in order to allow for repeated use of the beverage insulator 100 without an undesirable breaking, degradation, or deformation of the beverage insulator 100.

For example, the durable material may be sufficiently resilient to allow for repeated insertion and removal of the beverage container 101, without an undesirable degradation of the beverage insulator 100 due to friction. Likewise, the durable material should have a sufficiently high fatigue resistance to militate against damage to the beverage insulator 100 after torsion, bending, or flexing during use. The durable material may also have a sufficiently high heat resistance to allow for use with relatively hot beverages without an undesirable deformation of the beverage insulator 100, in operation.

In particular non-limiting embodiments, the durable material may be a plastic material. For example, the plastic material may be one of polycarbonate, acrylonitrile butadiene styrene, polyethylene terephthalate, polypropylene. In another non-limiting example, the durable material may be metal. In further embodiments, the durable material may be a silicone or elastomer material. Advantageously, the beverage insulator 100 may be fabricated from a combination of durable materials, in order to reach the desired physical properties of the beverage insulator 100.

According to certain embodiments of the present disclosure, the beverage insulator 100 may be manufactured by a 3D printing process. Advantageously, a manufacturing of the beverage insulator 100 via the 3D printing process allows for customization of the beverage insulator 100. A skilled artisan may select other suitable methods to manufacture the beverage insulator 100, as desired.

With continued reference to FIGS. 1-15, the main body 102 may have a base wall 104 and a side wall 106. The side wall 106 may be disposed on the base wall 104 to form the main body 102. The side wall 106 may have a major interior surface 108 with an upper portion 109, which may define a bore 110 of the main body 102. The bore 110 may be configured to receive the beverage container 101. Likewise, the bore 110 may have a shape, which corresponds to a shape of the beverage container 101. For example, the bore 110 may be substantially cylindrical where the beverage container 101 is in the form of a can or bottle. It should be appreciated that a skilled artisan may select other suitable shapes for the bore 110, as needed.

The bore 110 may have a diameter (D1), which corresponds to a diameter (D2) of the beverage container 101. The diameter (D1) of the bore 110 may be substantially equal to the diameter (D2) of the beverage container 101. In particular, the diameter (D1) may allow the beverage container 101 to be disposed in the beverage insulator 100, while militating against an undesirable movement of the beverage container 101 within the beverage insulator 100.

In particular examples, the diameter (D1) of the bore 110 may be approximately 66 mm, which is substantially equivalent to the diameter (D2) of a standard, commercially available twelve (12) fluid ounce can. In other examples, the diameter (D1) of the bore 110 may be approximately 58 mm, which is substantially equivalent to the diameter (D2) of a standard, commercially available sleek twelve (12) fluid ounce can. A skilled artisan may select other suitable diameters (D1) for the beverage insulator 100, as desired.

The bore 110 may have a height (H1), which corresponds to a height (H2) of the beverage container 101. The height (H1) of the bore 110 may be less than or equal to the height (H2) of the beverage container 101. In particular, the height (H1) of the bore 110 may be less than the height (H2) of the beverage container 101 to allow a user to easily drink from the beverage container 101. It should be appreciated that suitable heights (H1) for the bore 110 may be selected within the scope of the present disclosure.

Figure 2:
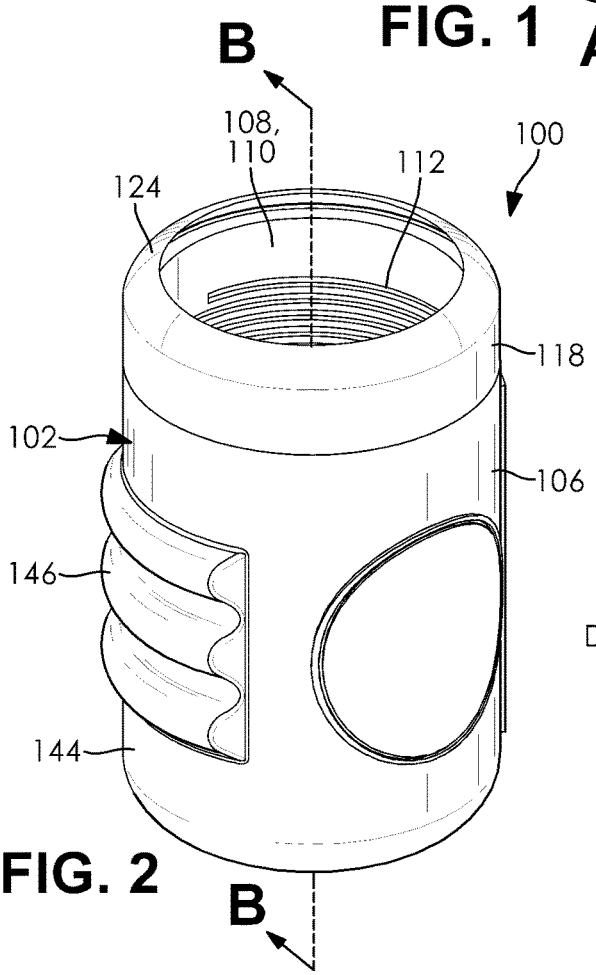
FIG. 2 is a top perspective view of the beverage insulator of FIG. 1, further depicting the beverage insulator with the beverage container removed.
Figure 3:
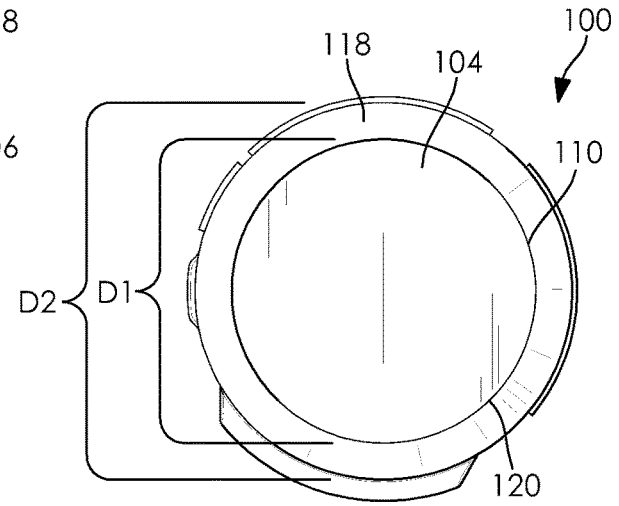
FIG. 3 is a top plan view of the beverage insulator of FIG. 2.
Figure 4:
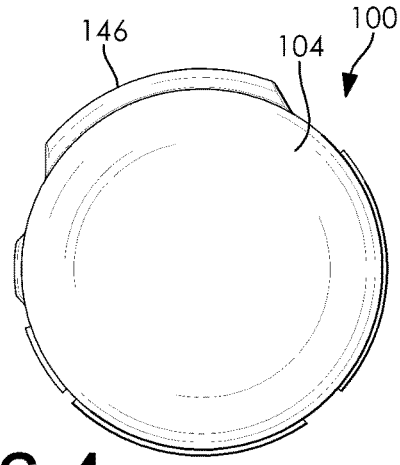
FIG. 4 is a bottom plan view of the beverage insulator of FIG. 2
Figure 5:
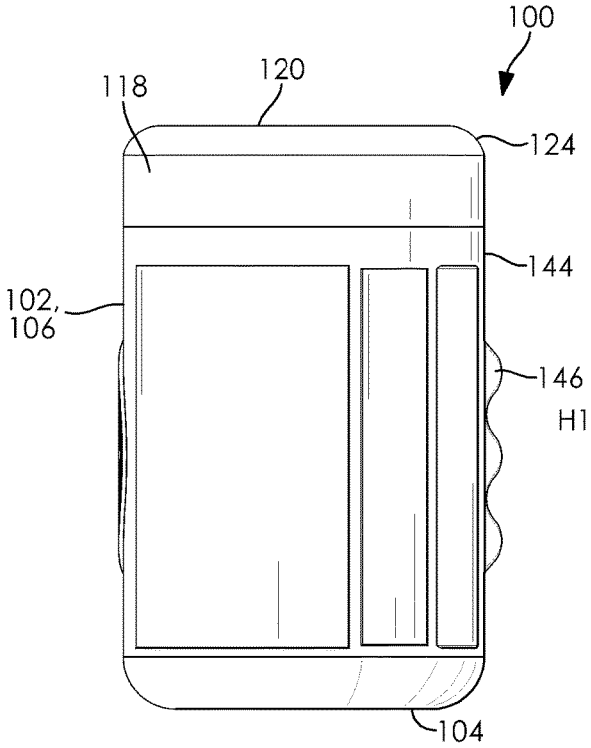
FIG. 5 is a side elevational view of the beverage insulator of FIG. 2
Figure 6:
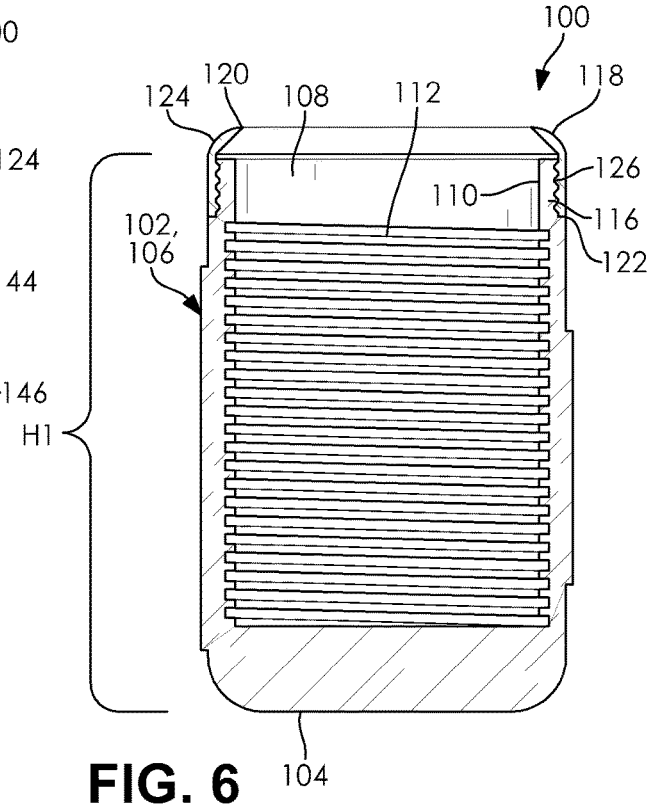
FIG. 6 is a cross-sectional side elevational view of the beverage insulator taken at section line B-B in FIG. 2, further depicting a helical groove of the beverage insulator.
Figure 7:
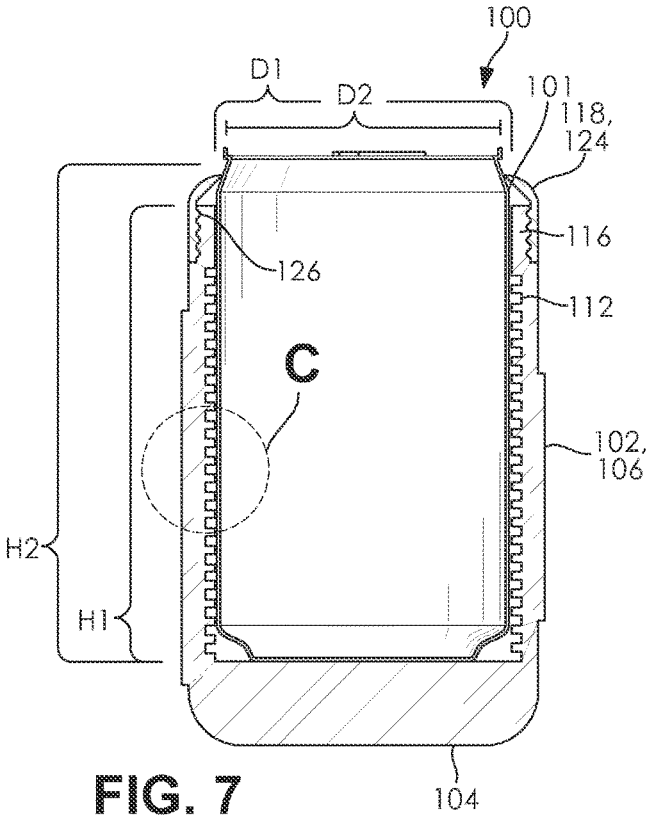
FIG. 7 is a cross-sectional side elevational view of the beverage insulator taken at section line A-A in FIG. 1, further depicting the helical groove of the beverage insulator.
Figure 8:
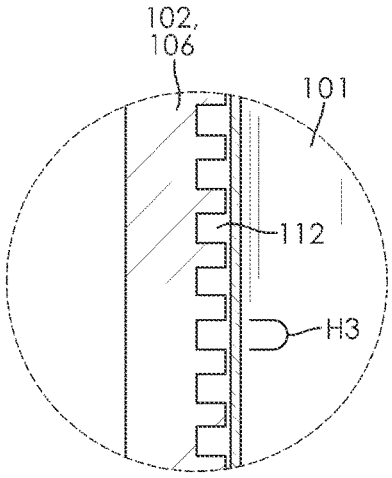
FIG. 8 is an enlarged, cross-sectional, side elevational view of the beverage insulator taken at cutout C in FIG. 7, further depicting an interaction of the helical groove with the beverage container.
Figure 9:
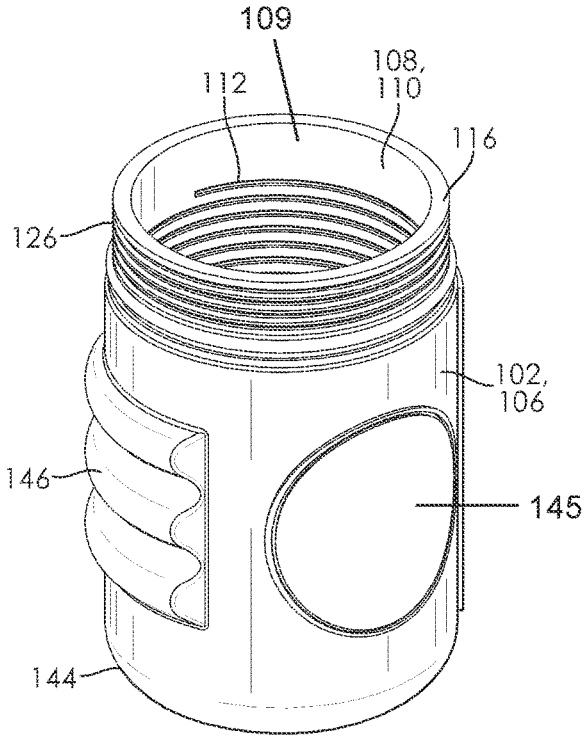
FIG. 9 is a top perspective view of the beverage insulator of FIG. 1, further depicting the beverage insulator with a lid removed.

As shown in FIGS. 2 and 6-7, the major interior surface 108 may have a groove 112 formed therein. The groove 112 may be disposed in a helical pattern or a spiral pattern along the height (H1) of the major interior surface 108. The helical groove 112 may be configured to promote a formation of one or more air pockets between the groove 112 and the beverage container 101. Advantageously, the formation of the one or more air pockets may provide an insulating effect within the beverage insulator 100, which may militate against a change in temperature in the beverage disposed in the beverage container 101.

The groove 112 may be recessed from the major interior surface 108. The groove 112 may be recessed from about 0.5 mm to about 2 mm, and most particularly about 1 mm. The groove 112 may have a height (H3). The height (H3) of the groove 112 may be from about 0.5 mm to about 2 mm, and most particularly about 1 mm. A skilled artisan may select other suitable measurements for the groove 112, as desired.

Figure 12:
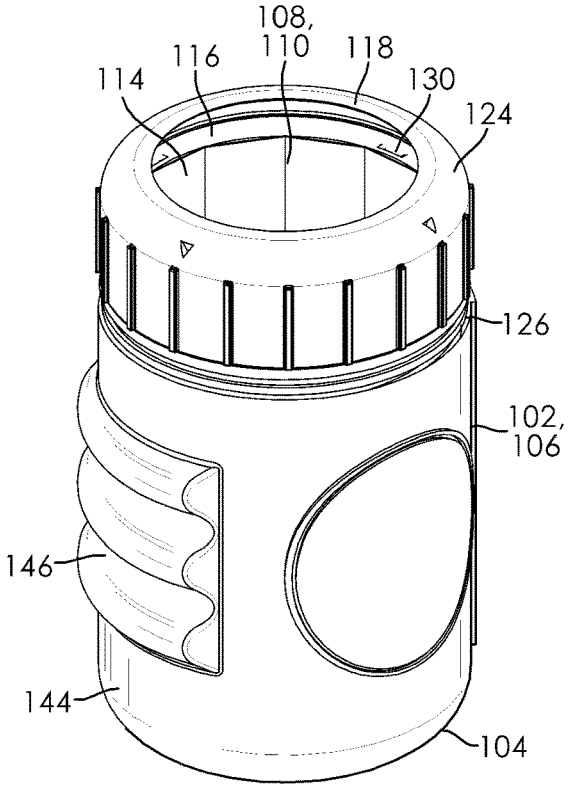
FIG. 12 is a top perspective view of the beverage insulator according to another embodiment of the present disclosure.
Figure 13:
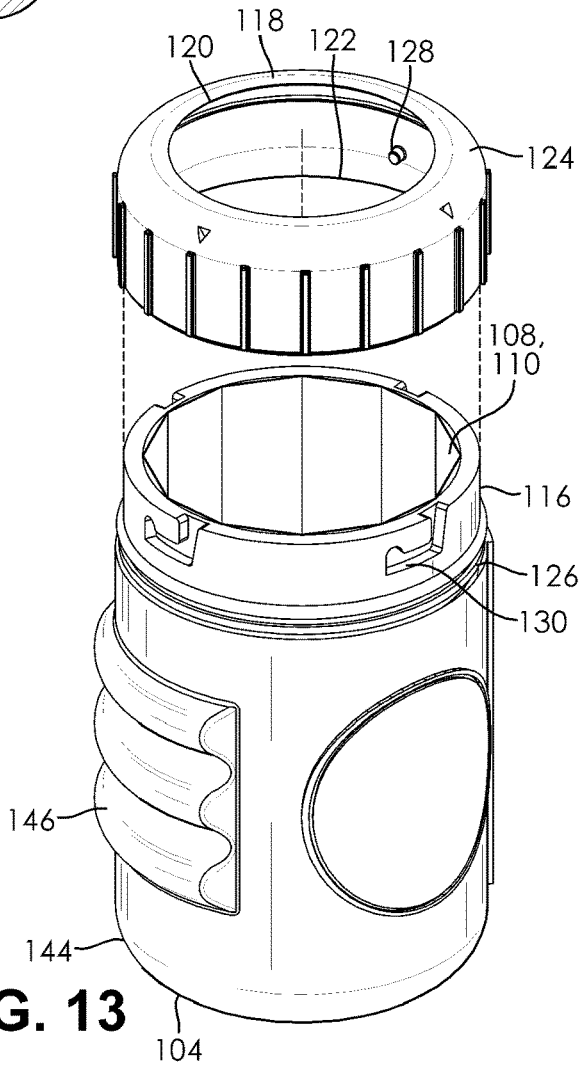
FIG. 13 is an exploded top perspective view of the beverage insulator of FIG. 11, further depicting a prong of the lid and a channel of a lip of the main body.
Figure 14:
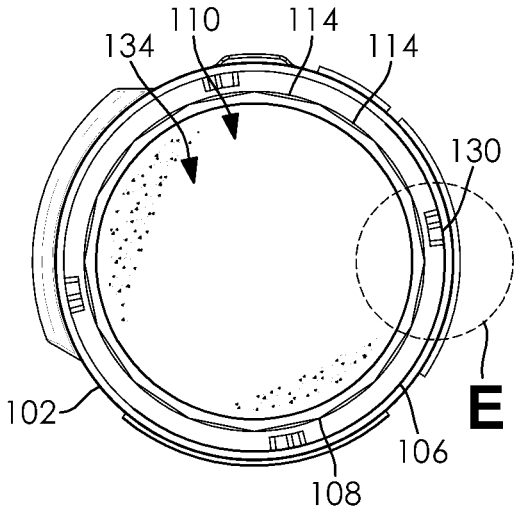
FIG. 14 is a top plan view of the beverage insulator of FIG. 11, further depicting the beverage insulator without the lid and with a plurality of angled walls.
Figure 15:
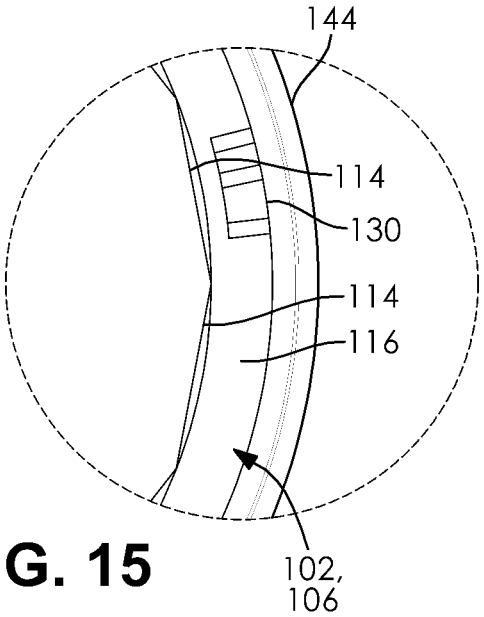
FIG. 15 is an enlarged top plan view taken at cutout E in FIG. 13, further depicting the plurality of angled walls.

With reference to FIGS. 12-14, the major interior surface 108 may have a plurality of angled walls 114. The plurality of angled walls 114 may be disposed along the height (H1) of the major interior surface 108. It should be appreciated that the plurality of angled walls 114 may be disposed along an entirety of the height (H1) of the major interior surface 108, or along only a portion of the height (H1).

The plurality of angled walls 114 may be disposed at only a top portion or a bottom portion of the major interior surface 108. The plurality of angled walls 114 may be configured to engage or grip the beverage container 101, in operation, by providing friction between the major interior surface 108 and the beverage container 101. Advantageously, the plurality of angled walls 114 may militate against the beverage container 101 from undesirably shifting within the beverage insulator 100, which may militate against the user spilling the beverage.

For example, as shown in FIG. 14, the major interior surface 108 may have a cross-section that may be a hexadecagon shape. The hexadecagon shape may be defined by sixteen angled walls 114. A skilled artisan may select other suitable shapes for the plurality of angled walls 114, as desired.

The bore 110 may be circumscribed by a lip 116. More particularly, the lip 116 may extend outwardly from the side wall 106 of the main body 102. The lip 116 may be configured to receive a lid 118. The lid 118 may be cylindrical in shape with a top opening 120 and a bottom opening 122. The bottom opening 122 may be configured to be disposed on the lip 116 of the main body 102. The top opening 120 may be configured to be disposed adjacent to either a neck of the bottle or a rim of the can, in operation.

The top opening 120 may have a diameter (D3) and the bottom opening 122 may have a diameter (D4). The diameter (D3) of the top opening 120 may be smaller than the diameter (D4) of the bottom opening 122. A difference in the diameters (D3), (D4) may correspond to a structure of the can or the bottle, as these beverage containers 101 typical have tapered portions, such as the rim or the neck. Accordingly, the lid 118 may have a curved or tapered portion 124 between the top opening 120 and the bottom opening 122, which corresponds with the structure of the rim of the can or the neck of the bottle, as shown in FIGS. 1-2 and 6-7. The tapered portion 124 may allow for a more comfortable use for the user while also securing the beverage container 101 within the main body 102.

The lid 118 may be secured to the lip 116 by mechanical means. As non-limiting examples, the lid 118 may be secured to the lip 116 via a press-fit, a snap-fit, a friction fit, complementary threading, or other mechanical engagement means. As shown in FIGS. 6-7, each of the lip 116 and the lid 118 may have corresponding threads 126. The threads 126 of the lip 116 may receive the threads 126 of the lid 118, thereby securing the lid 118 to the main body 102.

Figure 11:
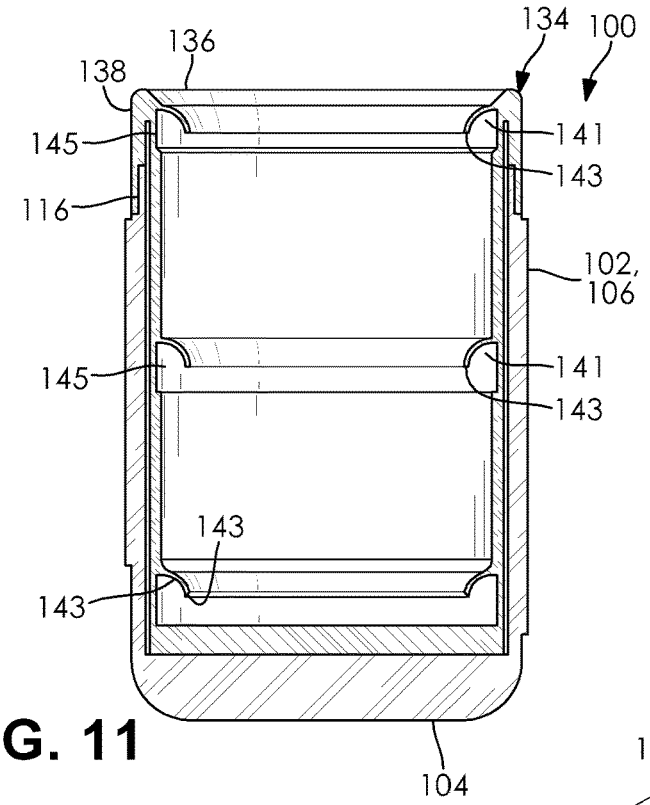
FIG. 11 is a cross-sectional side elevational view of the beverage insulator taken at section line D-D in FIG. 10, further depicting interior rings of the sleeve.

As shown in FIGS. 11-12, the lid 118 may have a prong 128 formed in an interior surface thereof. The lip 116 may have a corresponding channel 130 formed on an exterior surface thereof. The channel 130 may be configured to receive the prong 128, in operation. The channel 130 may be L-shaped. Advantageously, the L-shape of the channel 130 allows the user to twist the lid 118 into place, while securing the prong 128 into place. The interaction between the prong 128 and the channel 130 may secure the lid 118 to the main body 102.

In particular, a pad 132 may be disposed adjacent to the base wall 104 in the bore 110. The beverage container 101 may be disposed on the pad 132 by the user. The pad 132 may be configured to be depressed by the beverage container 101, which allows the prong 128 to be disposed into the channel 130 via a twisting of the lid 118 by the user until the prong 128 is locked in place. The pad 132 may automatically decompress and push up on the beverage container 101. The beverage container 101 may then press against the lid 118. The interaction between the beverage container 101, the lids 118, and the pad 132 may cooperate to fix the beverage container 101 within the main body 102.

The pad 132 may be manufactured from a material that is capable of being compressed, while also capable of automatically depressing. For example, the pad 132 may be a foam material or a rubberized material. A skilled artisan may select other suitable materials for the pad 132, as desired.

It should be appreciated that a combination of methods for securing the lid 118 to the lip 116 may be employed concurrently. For example, the lid 118 may include both the prong 128 and the threads 126 to secure the lid 118. Likewise, the lip 116 may have both the channel 130 and the threads 126. A skilled artisan may select other suitable means for securing the lid 118 to the lip 116, as desired.

In certain embodiments, the lid 118 may have a plurality of ridges 133 formed thereon. The plurality of ridges 133 may provide a grip for the lid 118. In particular, the ridges may allow the user to twist and untwist the lid 118 more easily. Advantageously, the plurality of ridges 133 may allow the user to twist and untwist the lid 118 where the lid 118 is wet or slick.

Figure 10:
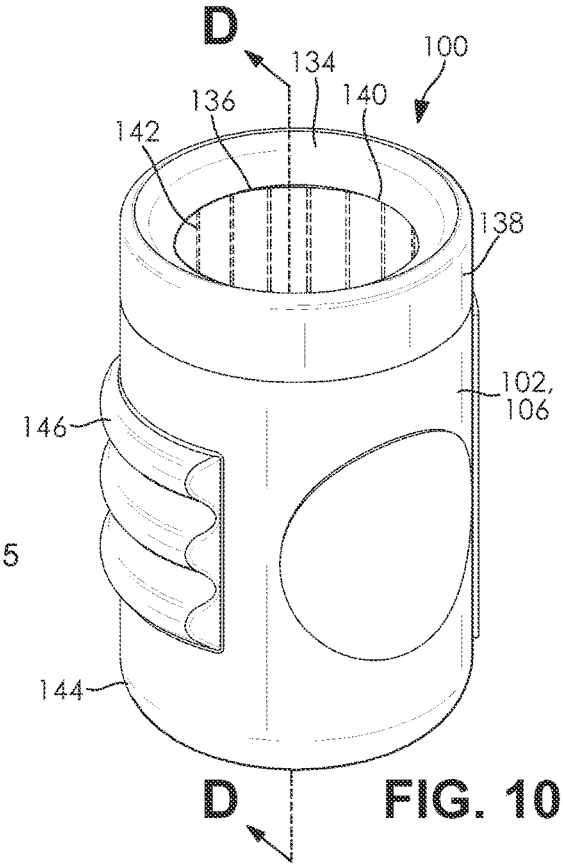
FIG. 10 is a top perspective view of the beverage insulator according to another embodiment of the present disclosure, further depicting a sleeve of the beverage insulator.

As shown in FIGS. 10-11, the main body 102 may be configured to receive a sleeve 134. The sleeve 134 may be configured to receive the beverage container 101. The sleeve 134 may be made of a rubber or a rubberized material, as non-limiting examples. The rubber may allow for increased friction between the sleeve 134 and the main body 102, which may secure the sleeve 134 within the main body 102. The rubber may also allow for increased friction between the sleeve 134 and the beverage container 101, which may secure the beverage container 101 within the sleeve 134.

It should be further appreciated that the durable material of the main body 102 and the rubberized material of the sleeve 134 may cooperate to provide a beverage insulator 100, which is more impact resistant than a beverage insulator 100 without the sleeve 134. The rubberized material may militate against damage to both the main body 102 and the beverage container 101, if the user drops the beverage insulator 100. A skilled artisan may select other suitable materials for the sleeve 134, as desired.

The sleeve 134 may have a shape that conforms to the shape of the bore 110. Accordingly, the sleeve 134 may have a cylindrical aperture 136. The cylindrical aperture 136 may be configured to receive the beverage container 101, in operation. The cylindrical aperture 136 of the sleeve 134 may have an outer rim 138. The outer rim 138 may circumscribe the cylindrical aperture 136 at a top of the sleeve 134. When the sleeve 134 is disposed in main body 102, the outer rim 138 may surround the lip 116 of the main body 102. Advantageously, the outer rim 138 may, therefore, protect the lip 116 in operation, while also providing a comfortable surface for the user to hold.

A sealing ring 140 may be disposed adjacent to the outer rim 138. More particularly, the sealing ring 140 may extend inwardly from outer rim 138 at the top of the sleeve 134. Advantageously, the sealing ring 140 may create a seal with the beverage container 101. The seal may hold cold air between the beverage container 101 and the sleeve 134, which may militate against the beverage container changing temperature. Additionally, the sealing ring 140 may allow the sleeve 134 to accommodate varying sized beverage containers 101.

As shown in FIG. 11, the sealing ring 140 of the sleeve 134 may be configured as at least one ring 141 disposed on an interior surface of the sleeve 134. More particularly, the sleeve may have a plurality of rings 141 disposed on the interior surface thereof, such as the three rings 141 as depicted in FIG. 11. One of the rings 141 may be disposed adjacent a bottom of the sleeve 134. One of the rings 141 may disposed adjacent to adjacent the top of the sleeve 134. Another one of the rings 141 may be disposed substantially centrally between the other rings 141. The rings 141 may work cooperatively to hold the beverage container in place 101. Each of the rings 141 may be configured to be depressed by the beverage container 101, in operation. Advantageously, the plurality of rings 141 may provide additional stability and optimized engagement to the beverage container 101, in operation.

Each of the rings 141 may be a flap with a free edge 143 such that the flap may be selectively pressed into the interior surface of the sleeve 134. The flap may be biased towards the top of the sleeve 134 and may extend inwardly from the interior surface of the sleeve 134. A ridge 145 may be formed in the interior surface of the sleeve 134 below each of the rings 141. Each of the ridges 145 may be configured to receive the adjacent ring 141 when the ring is compressed by the beverage container 101. Where the ring 141 is fully compressed, the ring 141 may be flush with the interior surface of the sleeve 134. Each of the rings 141 may be sufficiently rigid to hold the beverage container 101 in place. Accordingly, each of the rings 141 may automatically extend towards the beverage container 101 to grip the beverage container 101 and to hold it in place. Additionally, each of the rings 141 may be segmented to provide additional flexibility, in operation.

The user may press the beverage container 101 into the sleeve 134. Each of the rings 141 may be decompressed towards ridge 143 in the interior surface of the sleeve 134. When the beverage container 101 is placed into the sleeve, each of the rings 141 may be depressed a distance based on the diameter (D2) of the beverage container. In other words, a beverage container 101 with a larger diameter (D2) may decompress the rings 141 further into the ridge 145 than a beverage container with a comparatively smaller diameter (D2). Advantageously, the rings 141 allow the sleeve 134 to accommodate beverage containers 101 of varying sizes, including beverages containers 101 of various diameters, which may allow the user to insert the can, the slim can, or the bottle into one sleeve 134 without needing to change the size of the beverage insulator 100.

The sleeve 134 may have a plurality of ribs 142 formed on an exterior surface thereof. The plurality of ribs 142 may reinforce the sleeve 134. The plurality of ribs 142 may allow the sleeve 134 to be sufficiently rigid, to militate against an undesirable bending of the sleeve 134, in operation.

With reference to FIGS. 1-15 an exterior surface 144 of the side wall 106 may have a plurality of surface features. The surface features may be customizable for each individual user. For example, a name plate 145 may be formed on the exterior surface 144. Various logos and designs may be disposed on the exterior surface 144. Advantageously, the user may customize the beverage insulator 100 by selecting any suitable designs for the exterior surface 144.

The surface feature may be a handgrip 146. The handgrip 146 is configured to permit the user to more securely grip the beverage insulator 100, during use. The handgrip 146 may include of a plurality of ridges and corresponding lands disposed on the side wall 106 of the main body 102. The plurality of ridges may be positioned in such a way that allows a finger of a user to be disposed between two ridges thereby providing a grip during use. A skilled artisan may employ other suitable handgrips 146 for the beverage insulator 100, as desired.

Figure 16:
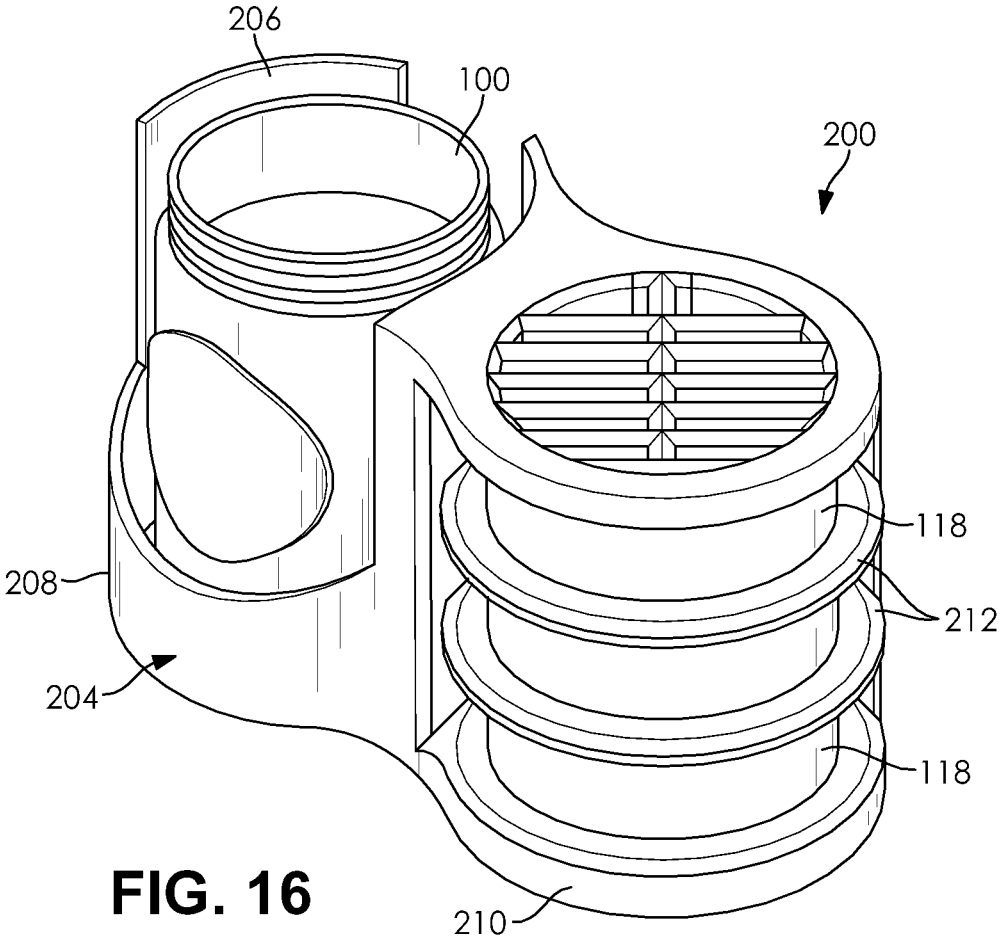
FIG. 16 is a top perspective view of a kit according to a further embodiment of the present disclosure.
Figure 17:
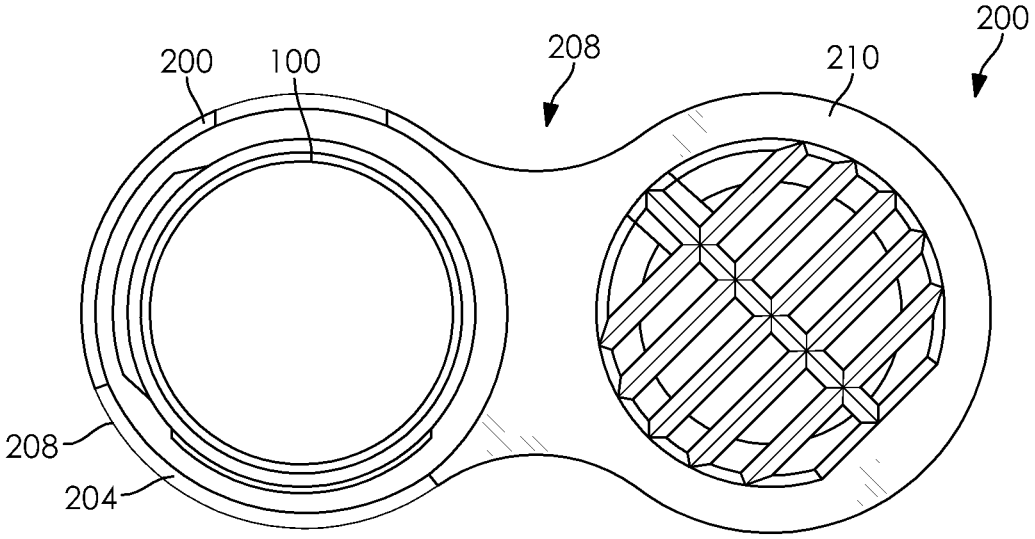
FIG. 17 is a top plan view of the kit of FIG. 15.
Figure 18:
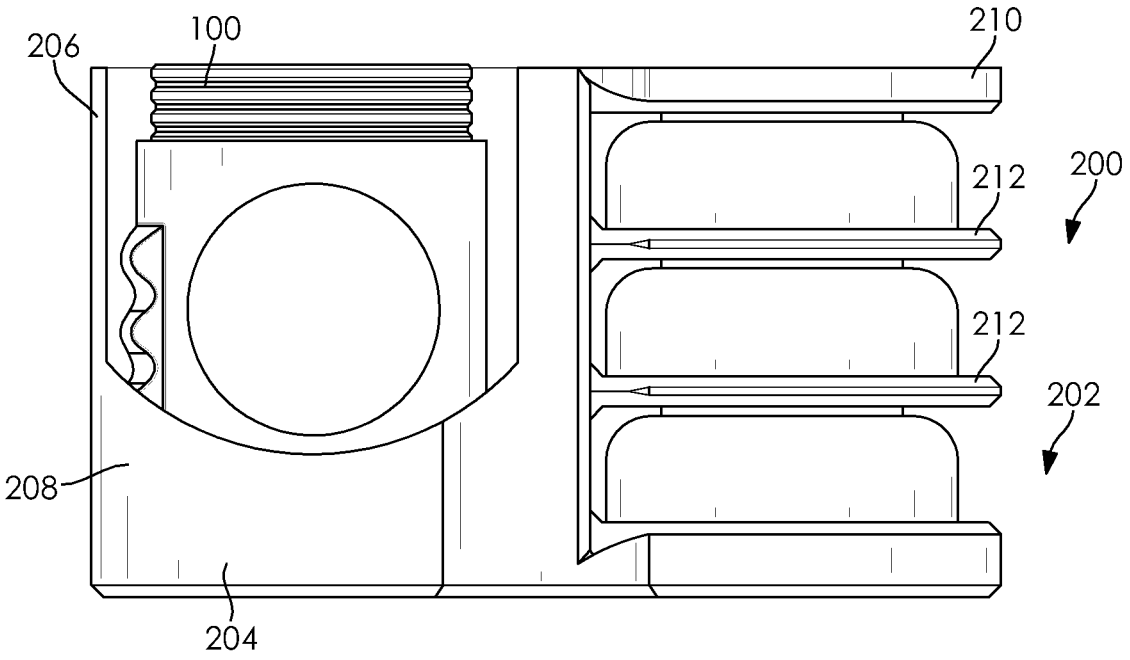
FIG. 18 is a side elevational view of the kit of FIG. 15.

The present disclosure also contemplates a beverage insulator kit 200, for example, as shown in FIGS. 16-18. The beverage insulator kit 200 may include the beverage insulator 100, as described hereinabove, and a caddy 202. The caddy 202 may be configured to store and transport the beverage insulator 100. It should be appreciated that the caddy 202 may have scalable dimensions, such that the caddy 202 may have dimensions which correspond with dimensions of the particular beverage insulator 100 that will be stored in the caddy 202.

The caddy 202 may have a holder 204. The holder 204 may be configured to receive the beverage insulator 100. The holder 204 may be have a first side wall 206 and a second side wall 208. The first side wall 206 may be taller than the second side wall 208. Advantageously, each of the first side wall 206 and the second side wall 208 may be configured to hold the beverage insulator 100 within the holder 204. However, the relatively shorter second side wall 208 may allow the user to display the customize surface features of the beverage insulator 100.

The holder 204 may have a shelving portion 210 disposed adjacent to the holder 204. The shelving portion 210 may include a plurality of shelves 212. Each of the shelves 212 may be grated. Advantageously, the grated shelves 212 allow for drainage of liquid from the shelving portion 210, in operation. Each of the shelves 212 may be configured to receive one of the lids 118.

Advantageously, the beverage insulator 100 of the present disclosure militates against the change in temperature in the beverage container 101 disposed therein. Further, the beverage insulator 100 provides advantages and improvements over known devices, including a more durable exterior to protect the insulator 100, and provide a comfortable surface for the user. Additionally, the beverage insulator 100 is highly customizable. The kit 200 of the present disclosure provides the ability to transport and store the beverage insulator 100, while also displaying the customizations of the user's particular insulator 100.

Example embodiments are provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms, and that neither should be construed to limit the scope of the disclosure. In some example embodiments, well-known processes, well-known device structures, and well-known technologies are not described in detail. Equivalent changes, modifications and variations of some embodiments, materials, compositions and methods can be made within the scope of the present technology, with substantially similar results.

What is claimed is:

1. A beverage insulator for a beverage container, the beverage insulator comprising:

a main body configured to receive the beverage container, the main body having a bore with a helical groove formed therein, the helical groove configured to facilitate formation of at least one air pocket between the bore of the main body and the beverage container when the beverage container is received in the main body, the main body having a base wall and a side wall, the side wall having a major interior surface that defines the bore, the helical groove formed on the major interior surface, the side wall having a lip extending outwardly therefrom, the bore having a first diameter substantially equal to a diameter of the beverage container; and a lid having a top opening and a bottom opening, the bottom opening removably disposed on the lip of the side wall of the main body, the lid having a tapered portion disposed between the top opening and the bottom opening that corresponds with a structure of a rim of the beverage container, wherein the side wall of the main body has a major exterior surface disposed opposite the major interior surface, the major exterior surface having a handgrip, the handgrip including a plurality of ridges and lands that are positioned to permit a finger of a user to be disposed between two of the ridges to facilitate a gripping of the main body by the user, wherein the helical groove is recessed into the major interior surface of the main body and has a depth between about 0.5 mm to about 2 mm and a height between about 0.5 mm to about 2 mm, and a vertical distance between adjacent segments of the helical groove being less than the height of the helical groove, and wherein an upper portion of the major interior surface is disposed between a top of the helical groove and an uppermost edge of the lip of the sidewall, and each of the upper portion and the major interior surface have a same diameter that corresponds to a diameter of the beverage container.

2. The beverage insulator of claim 1 wherein each of the lip and the lid have cooperating threads configured to secure the lip to the lid.

3. The beverage insulator of claim 1, wherein the main body includes a material selected from a group consisting of polycarbonate, acrylonitrile butadiene styrene, polyethylene terephthalate, polypropylene, and combinations thereof.

4. The beverage insulator of claim 1, further including a raised name plate disposed on the major exterior surface adjacent to the handgrip.

5. A beverage insulator kit for use with a beverage container, the beverage insulator kit comprising:

a beverage insulator having a main body configured to receive the beverage container, the main body having a bore with a helical groove formed therein, the helical groove configured to facilitate formation of at least one air pocket between the bore of the main body and the beverage container when the beverage container is received in the main body, the main body having a base wall and a side wall, the side wall having a major interior surface that defines the bore, the helical groove formed on the major interior surface, the side wall having a lip extending outwardly therefrom, the bore having a first diameter substantially equal to a diameter of the beverage container, and a lid having a top opening and a bottom opening, the bottom opening removably disposed on the lip of the side wall of the main body, the lid having a tapered portion disposed between the top opening and the bottom opening that corresponds with a structure of a rim of the beverage container, wherein the side wall of the main body has a major exterior surface disposed opposite the major interior surface, the major exterior surface having a handgrip, the handgrip including a plurality of ridges and lands that are positioned to permit a finger of a user to be disposed between two of the ridges to facilitate a gripping of the main body by the user, wherein the helical groove is recessed into the major interior surface of the main body and has a depth between about 0.5 mm to about 2 mm and a height between about 0.5 mm to about 2 mm, and a vertical distance between adjacent segments of the helical groove being less than the height of the helical groove, and wherein an upper portion of the major interior surface is disposed between a top of the helical groove and an uppermost edge of the lip of the sidewall, and each of the upper portion and the major interior surface have a same diameter that corresponds to a diameter of the beverage container; and a caddy having a holder and a shelving portion disposed on the holder, the holder configured to selectively receive the beverage insulator, and the shelving portion configured to selectively receive a plurality of lids.

6. The beverage insulator kit of claim 5, wherein the shelving portion has a plurality of grated shelves configured to drain liquids from the holder.

7. The beverage insulator kit of claim 5, wherein the beverage insulator further includes a raised name plate disposed on the major exterior surface adjacent to the handgrip.

* * * * *